United States Patent [19]

Duran et al.

[11] Patent Number: 4,595,826

[45] Date of Patent: Jun. 17, 1986

[54] HEAT TREATMENT FURNACE AND METHOD OF CONSTRUCTION

[76] Inventors: Reginald F. Duran, 231 E. Borromeo, Placentia, Calif. 92670; Jack L. Brass, 5650 Via Ceresa, Yorba Linda, Calif. 92686

[21] Appl. No.: 637,316

[22] Filed: Oct. 5, 1984

Related U.S. Application Data

[62] Division of Ser. No. 368,307, Apr. 14, 1982, abandoned.

[51] Int. Cl.[4] ..... H05B 3/06

[52] U.S. Cl. ..... 219/400; 373/130; 373/137; 219/531

[58] Field of Search ..... 219/400, 531, 536, 542, 219/546, 357, 408, 532; 373/130, 137, 119, 128; 338/279, 280, 281, 293, 283, 291

[56] References Cited

U.S. PATENT DOCUMENTS

| | | | |
|---|---|---|---|
| 3,705,253 | 12/1972 | Hicks | 373/137 |
| 3,987,237 | 10/1976 | Phillips | 373/130 |
| 4,088,825 | 5/1978 | Carr | 373/130 |
| 4,418,415 | 11/1983 | Raymond | 219/531 |
| 4,443,881 | 4/1984 | Northcutt | 373/137 |
| 4,486,888 | 12/1984 | Sevink | 373/137 |

*Primary Examiner*—Clarence L. Albritton
*Assistant Examiner*—Teresa J. Walberg
*Attorney, Agent, or Firm*—Hubbard, Stetina & Brunda

[57] ABSTRACT

An improved heat treatment furnace and method of constructing the same is enclosed wherein the duct work of the furnace includes directional vanes and adjustable plenum vents and chamber dampers to yield a substantially uniform air flow pattern within the heat treatment chamber. The plenum vents and chamber dampers are provided with remotely operable actuating means which permit rapid adjustment of the vents and dampers from the exterior of the furnace during the heat treatment process and/or furnace certification. The furnace additionally incorporates a novel ribbon heating element/fiber insulation assembly and construction method which substantially reduces furnace operating costs and insures that only convectional heat transfer (as opposed to radiant) occurs within the heat treatment chamber of the furnace.

6 Claims, 12 Drawing Figures

Fig. 1
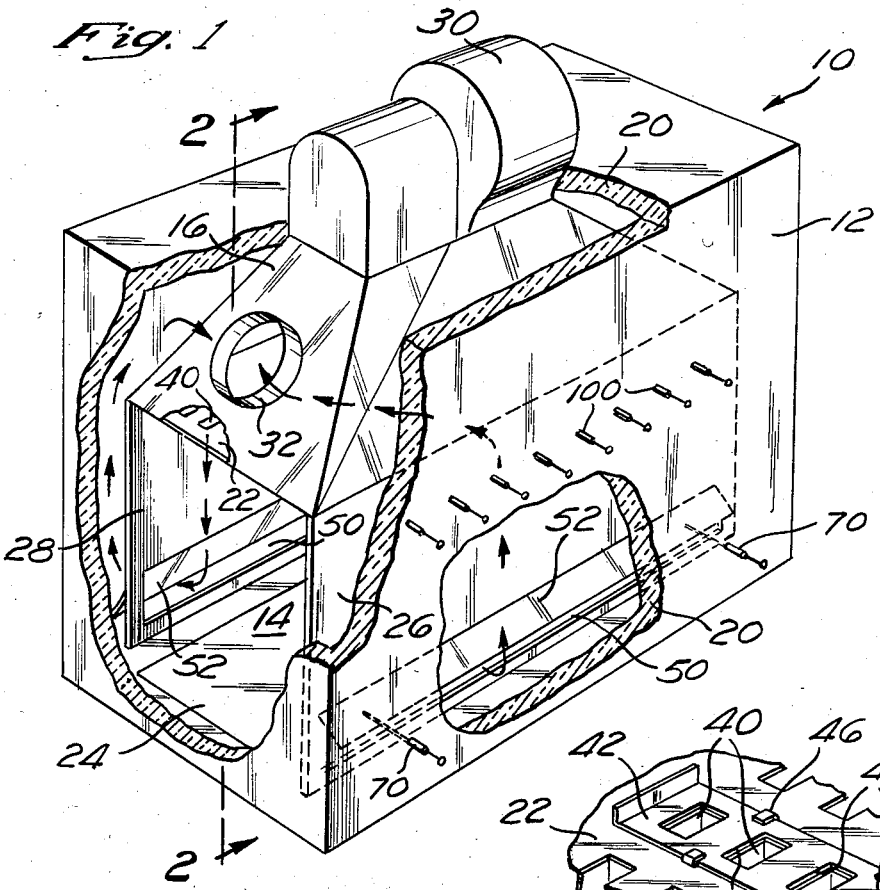
Fig. 3a
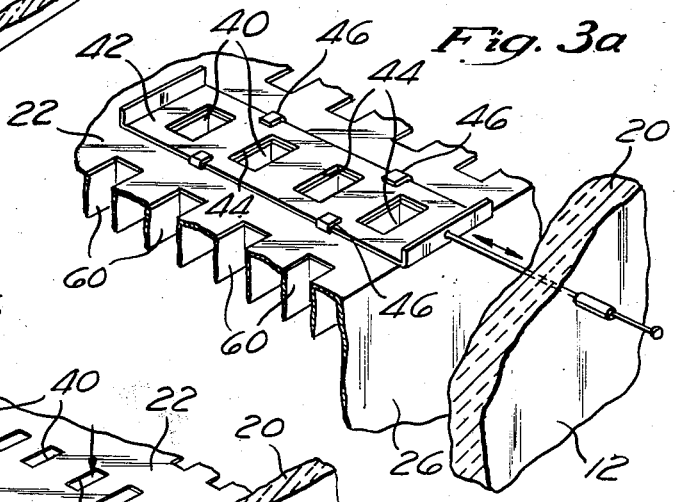
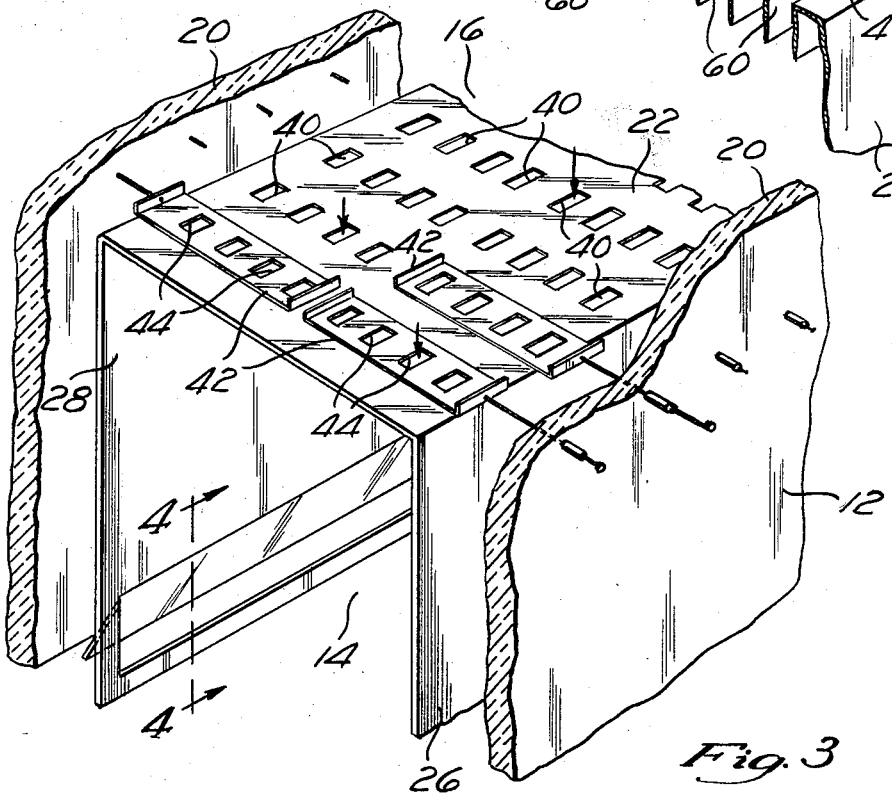
Fig. 3

Fig. 4
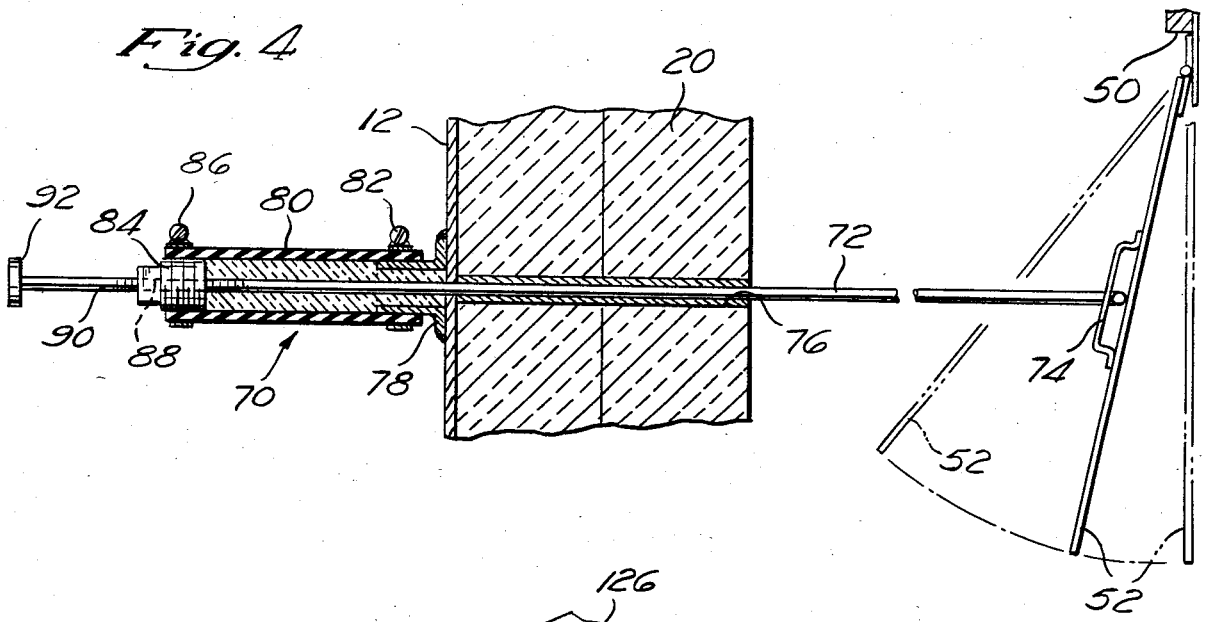
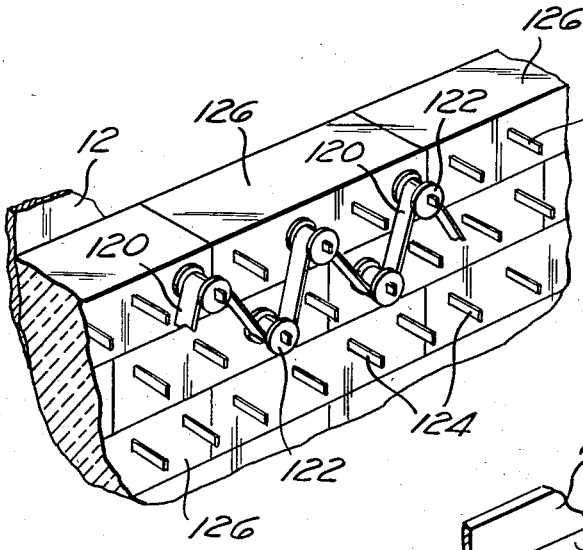
Fig. 5
(PRIOR ART)
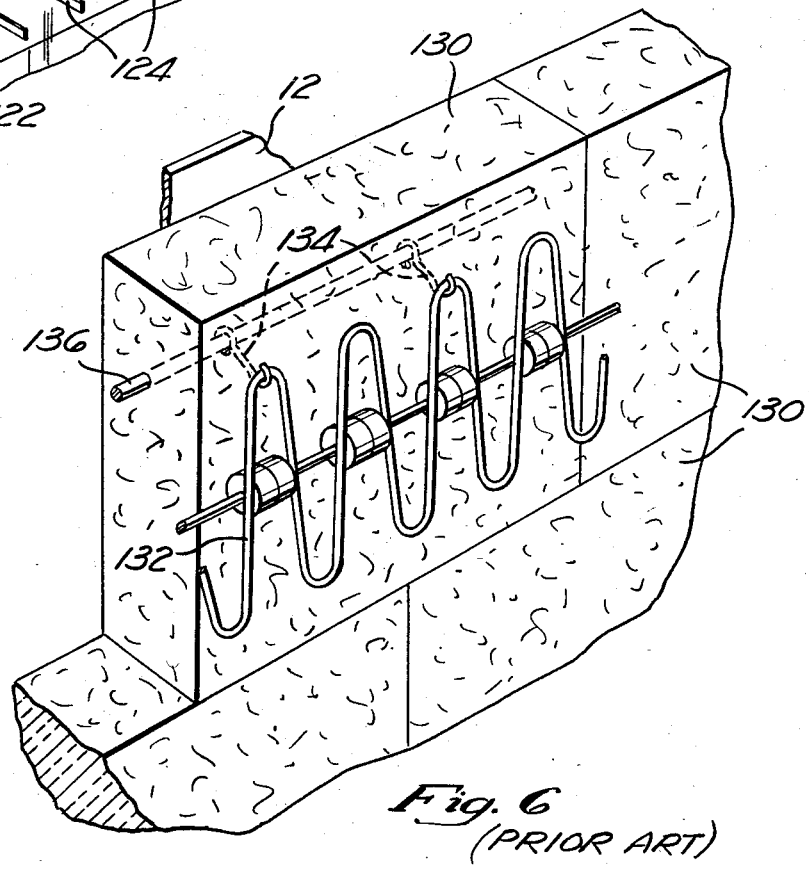
Fig. 6
(PRIOR ART)

Fig. 7
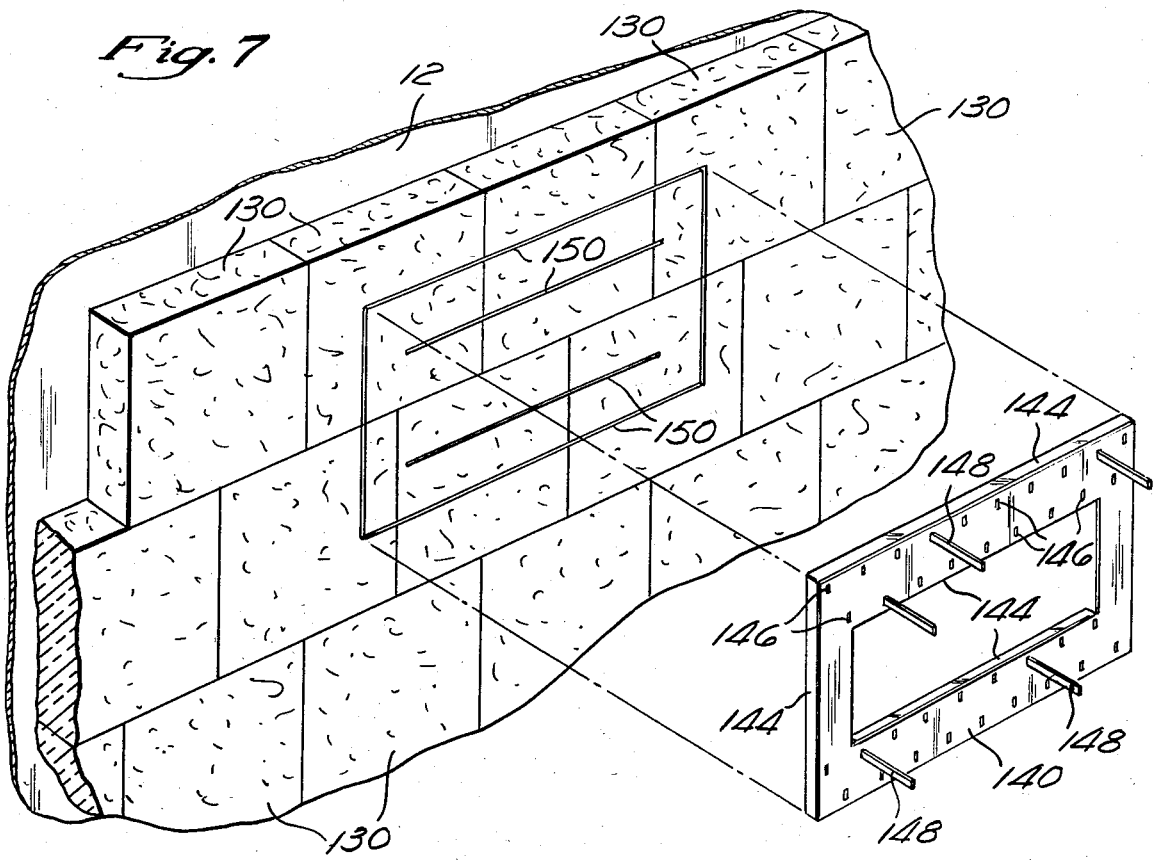
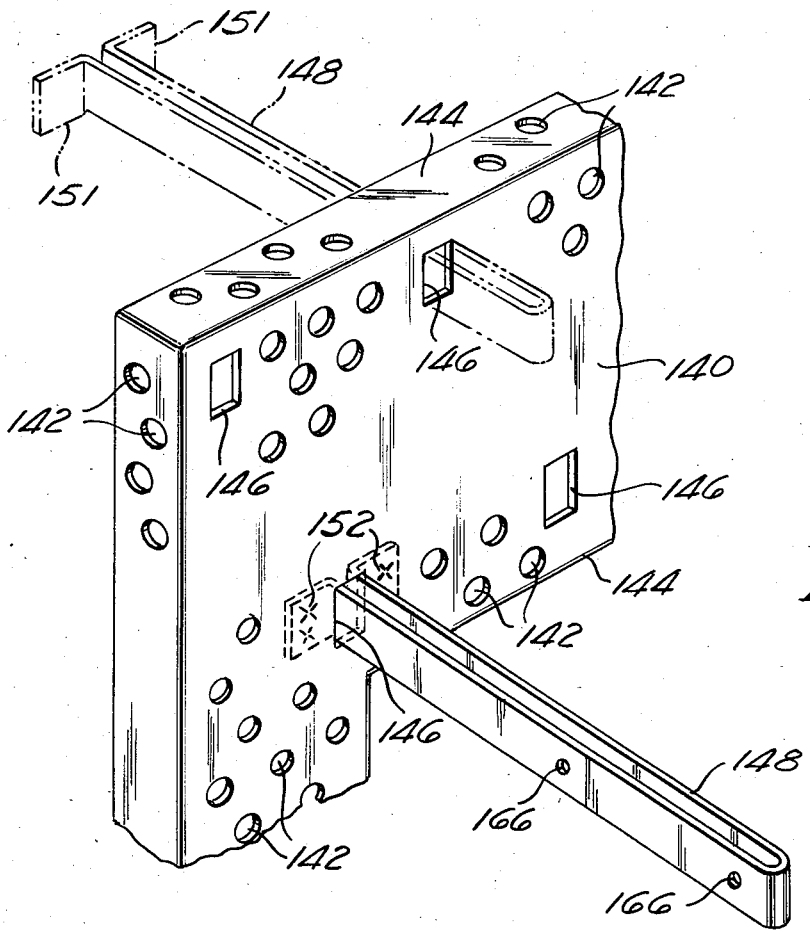
Fig. 8

Fig. 9
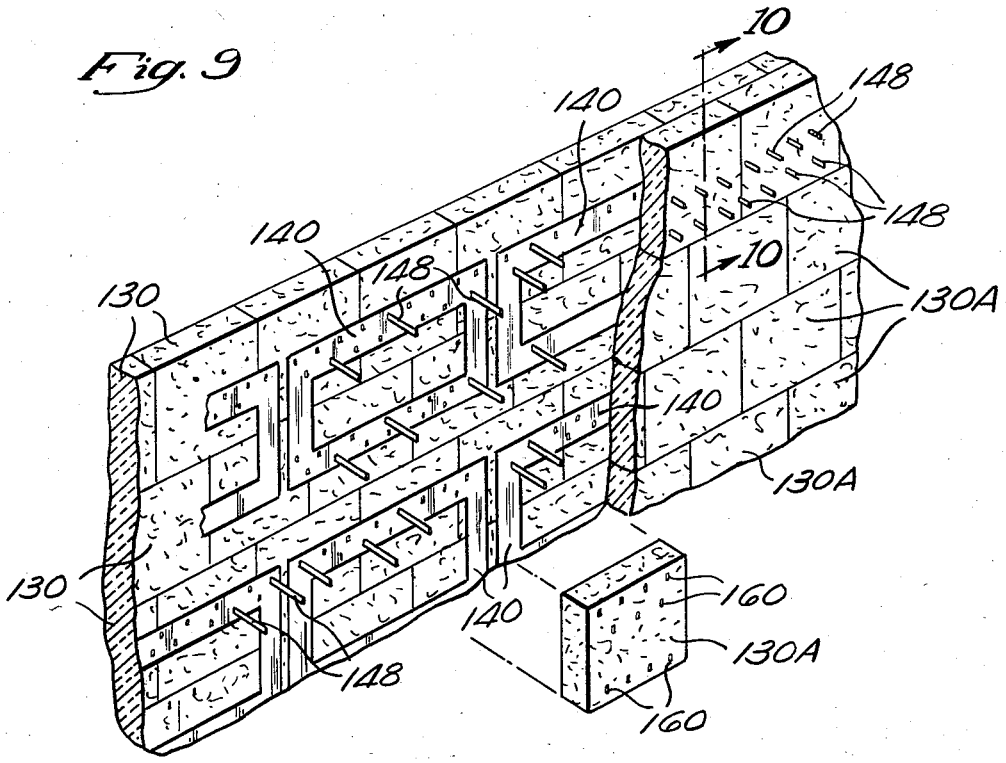
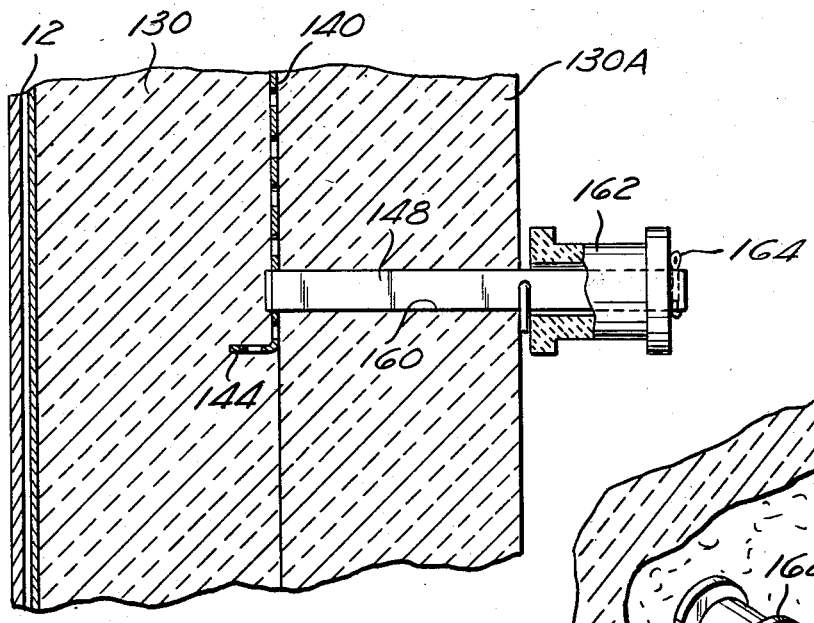
Fig. 10
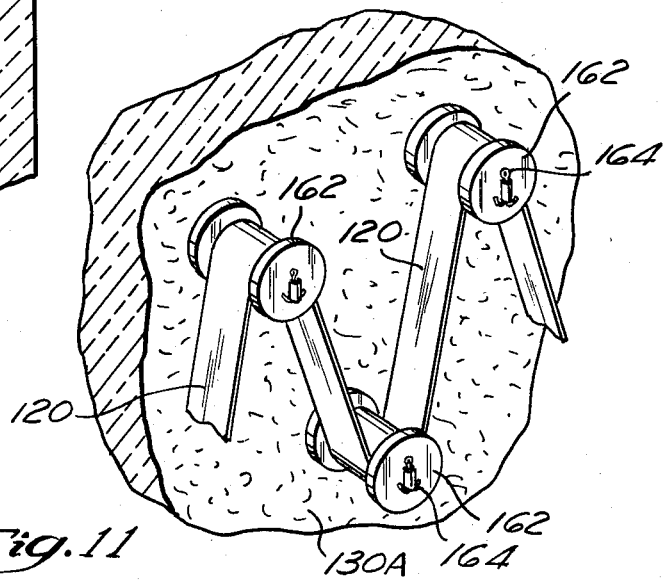
Fig. 11

HEAT TREATMENT FURNACE AND METHOD OF CONSTRUCTION

This application is a division, of application Ser. No. 368,307, filed 4/14/82, now abandoned.

BACKGROUND OF THE PRESENT INVENTION

The present invention relates to heat treatment furnaces and more particularly, to an improved aluminum solution-type heat treatment furnace and method of constructing the same.

As is well known, many steel and aluminum fabricated parts must be heat treated to modify the physical properties (i.e., hardness of the parts) to suit their intended structural use. With specific reference to the heat treatment of aluminum fabricated parts, the heat treatment process contemplates the placement of the parts into an aluminum solution-type heat treatment furnace wherein the temperature of the aluminum parts is raised by convectional heat transfer to a predetermined temperature within a specific time interval, and subsequently quenched within a water or water/glycol bath to yield the desired physical properties to the aluminum part.

Conventional aluminum solution-type heat treatment furnaces have heretofore been constructed having an external furnace housing, the interior surface of which is lined with a plurality of rigid ceramic blocks, arranged in a brick wall-like orientation to form an insulating bearer and retard heat transfer through the housing. Typically, the rigid ceramic blocks mount along their inner surface, plural calrod or ribbon type resistance heating elements which are adapted to raise the temperatures of the air within the furnace to predetermined levels. A heat treatment chamber is defined within the interior of the furnace and is typically separated from direct communication with the heating elements. The top of the heating chamber typically communicates through plural opening or vents with an air plenum, while the sides of the chamber communicate with the heating elements through one or more damper openings.

In operation, air is supplied to the air plenum by circulating fans and is forced downward through the vents into the heating chamber and across the fabricated parts disposed therein to effectuate convectional heat transfer from the air to the fabricated parts. The air flow subsequently exits the heat treatment chamber through the chamber dampers and is pulled across the plural heating elements to be raised in temperature and subsequently recirculated to the plural fans. Usually, the plenum vents and chamber dampers may be manually adjusted from the interior of the heat treatment chamber to control the air flow through the chamber and, hence, the operating temperature of the furnace. Once the prefabricated part has been raised to a sufficient temperature within a predetermined time, the part is transported directly into a quenching bath to effectuate a proper heat treatment prefabricated parts. Although such prior art heat treatment furnaces have proven generally suitable for their intended use, they possess inherent deficiencies which detract from their overall effectiveness and efficiency.

A major deficiency of the prior art heat treatment furnaces has been their propensity to provide a random air flow path through the heat treatment chamber which results in temperature gradients existing within the heat treatment chamber. Such non-uniform temperatures within the heat treatment chamber often cause variations in the resultant heat treatment properties of the prefabricated parts, and in instances, fail to allow the furnace to be certified for the desired heat treatment operation.

An additional deficiency of the prior art heat treatment furnaces has been their requirement of adjusting the plenum vents and chamber dampers exclusively from the interior of the heat treatment chamber. As such, when it was necessary to adjust the vents and dampers in an attempt to effectuate more uniform temperatures within the heating chamber, the prior art heat treatment furnaces mandated a complete shut-down and cooling of the chamber with a technician subsequently entering within the interior of the chamber and manually adjusting the vents on a trial and error basis. Subsequently to vent and damper adjustment, the furnace had to be heated back to operating temperatures and suitable inspections performed to insure the temperature gradients existing within the heat treatment chamber were within suitable tolerances. Oftentimes, such trial and error adjustment or certification of the furnace extended for weeks and even months, which necessarily detracted from the overall cost effectiveness of the heat treatment process.

Further, the use of the rigid ceramic block or refractory brick and bendover rod heating assemblies of the prior art furnace has proven to be extremely prohibitive during manufacture as well as during operation, in that substantial heat energy is dissipated from the blocks during the quenching process which necessitates rather long recovery times for the furnace. Additionally, the prior art calrod heating elements generate substantial quantities of radiant heat energy during operation, which is a detriment to aluminum heat treatment applications and, further, due to their relatively large mass, have proven generally difficult to precisely control to effecutate a proper temperature within the heat treatment chamber.

Although the heat loss deficiencies of the prior art ceramic block design have been recognized in the art with the recent industry introduction of ceramic fiber insulation having improved insulating characteristics, the use of such ceramic fiber insulation has been limited exclusively to calrod heating element assemblies. Hence, the radiation and temperature control deficiencies of the prior art have remained substantially unaddressed. In addition, although very recent attempts have been made to utilize such ceramic fiber insulation with ribbon-type heating elements which do not possess the radiant and temperature control deficiencies of calrod elements, such attempts have failed primarily due to the inability of the ceramic fiber insulation to possess sufficient structural integrity to rigidly support the required tensile mounting forces with ribbon-type heating elements.

Hence, there exists a substantial need in the art for a heat treatment furnace which provides uniform air flow throughout the heat treatment chamber, permits adjustment of the plenum vents and chamber dampers during the heat treatment operation, and incorporates a ceramic fiber insulation/ribbon-type heating element assembly and method of construction to improve the temperature control and the quench recovery time of the heat treatment furnace.

SUMMARY OF THE PRESENT INVENTION

The present invention specifically addresses and alleviates the above-referenced deficiencies associated in the prior art and is particularly suited for aluminum, solution-type heat treatment furnaces. More particularly, the present invention comprises an improved heat treatment furnace and method of constructing the same wherein a novel duct work structure is provided to yield a substantially uniform air flow pattern whithin the heat treatment chamber of the furnace. The novel duct work structure includes a plurality of directional air vanes extending from the lower surface of the air plenum which are arranged relative the plenum vents to direct air flow in a predetermined direction through the air chamber. Thus, the heretofore random air flow characteristics of the prior art have been eliminated, which the applicants have found to dramatically reduce the magnitude of temperature gradients existing within the interior of the heat treatment chamber.

To augment these improved air flow characteristics, the present invention additionally incorporates the use of remotely controlled plenum vents or louvres and chamber dampers which may be adjusted during the heat treatment process and/or during furnace certification from the exterior of the furnace. In the preferred embodiment, the particular mechanism for effectuating remote control of the vents and dampers comprises plural elongate rods which are threadedly connected to a coupling attached to the exterior housing of the furnace and extends to each of the plenum vents and chamber dampers. By rotating the elongate rods, the size or effective opening of each of the vents and dampers may be independently controlled. In addition, structural means are provided to accommodate without binding, the substantial thermal expansion and contraction of the elongate rods encountered during the heat treatment process.

Further, the present invention provides a novel ribbon heating element/ceramic fiber insulation assembly and method of construction which substantially reduces operating costs for the heat treatment furnace and insures that only convectional heat transfer occurs within the heat treatment chamber of the furnace. In the preferred embodiment, this method of construction contemplates the use of a cartridge, embedded or sandwiched between two separate layers of ceramic fiber insulation, one of which is rigidly mounted to the furnace housing. The cartridge provides a rigid support member which mounts a plurality of elongate pins, each adapted to receive a ceramic insulating spool upon which the ribbon-type resistive heating elements may be strung. As such, the cartridge provides the sufficient structural integrity necessary to withstand the tensile forces exerted by the ribbon heating elements while insuring that thermal and electrical insulation between the heating elements and furnace housing is maintained.

DESCRIPTION OF THE DRAWINGS

These as well as other features of the present invention will become more apparent upon reference to the drawings wherein:

FIG. 1 is a perspective view of the improved heat treatment furnace of the present invention depicting the relative orientation of the furnace housing, heat treatment chamber, and air plenum;

FIG. 3 is a partial perspective view of the heat treatment furnace of the present invention depicting the construction of its adjustable plenum vents and chamber dampers;

FIG. 3A is an enlarged partial perspective view of one of the adjustable plenum vents and depicting the directional vanes extending downward from the plenum vents into the heat treatment chamber;

FIG. 4 is an enlarged cross sectional view taken about lines 4—4 of FIG. 3, illustrating the detailed construction of the actuator mechanism for remotely controlling the chamber damper and plenum vents of the present invention;

FIG. 5 depicts the ribbon-type heater element and rigid ceramic block construction of the prior art;

FIG. 6 depicts the conventional bend-over, rod heating element and ceramic fiber block construction of the prior art;

FIG. 7 is an enlarged exploded perspective view of the cartridge and ceramic fiber block construction of the present invention;

FIG. 8 is an enlarged partial perspective view of the cartridge and mounting pin assembly of the present invention;

FIG. 9 is a perspective exploded view illustrating the method of assemblying the cartridge and fiber block insulation to the furnace of the present invention;

FIG. 10 is an enlarged cross sectional view taken about lines 10—10 of FIG. 9 depicting the assembly of the insulating spools upon the mounting pins of the present invention; and FIG. 11 is a partial perspective view depicting the manner in which the ribbon-type heating elements extend between adjacent insulating spools.

DETAILED DESCRIPTION OF THE PREFERRED EMBODIMENT

Figure 2:
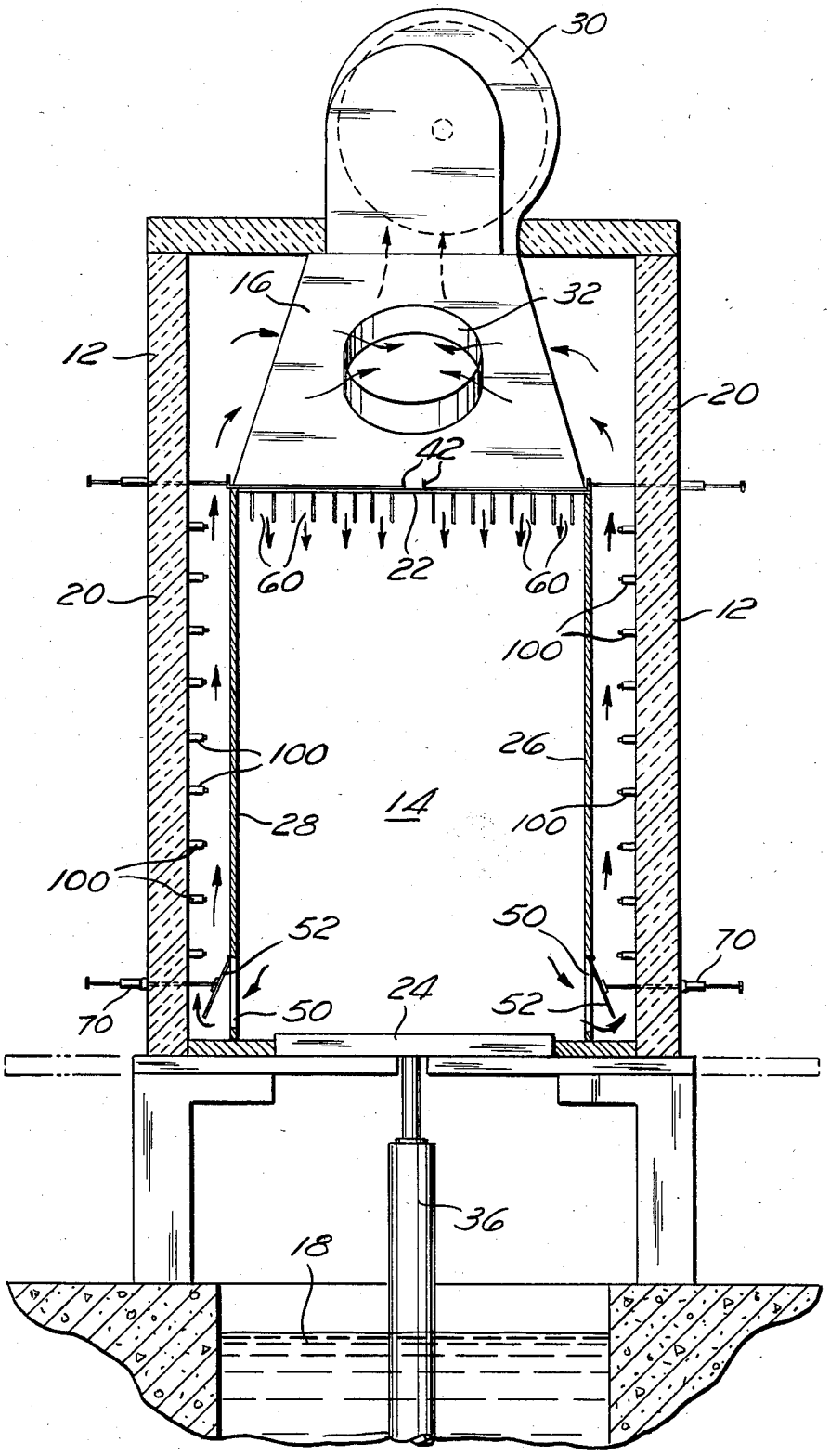
FIG. 2 is an enlarged cross sectional view taken about lines 2—2 of FIG. 1.

FIG. 1 depicts the improved heat treatment furnace 10 of the present invention, which by way of example, comprises an aluminum solution-type heat treatment furnace. The furnace 10 is composed generally of a housing 12, heat treatment chamber 14, air plenum 16 and quench bath or pit 18 (shown in FIG. 2). The housing 12 is preferably formed of three/sixteenth inch steel plates and includes a lining of thermal insulation 20 and a plurality of heater elements 100 (described in more detail infra) extending throughout its interior surfaces.

The heat treatment chamber 14 is disposed within the interior of the housing 12 and is defined by a top 22, bottom 24, and pair of side 26 and 28 partitions, customarily designated in the trade as false walls. The pair of side partitions 26 and 28 are spaced inwardly from the insulation lining 20 of the housing 12 to define an air flow passage between the housing 12 and heat treatment chamber 14. The air plenum 16 is rigidly mounted to the top partition 22 of the chamber 14 and in the preferred embodiment, comprises a double duct hood having one or more circulating fans 30 mounted adjacent its uppermost end. The intake for the circulating fans 30 is provided by a duct opening 32 formed in one of the duct channels of the air plenum 16 while the outlet of the circulating fan 30 is disposed to direct air discharged downward within the second duct channel of the air plenum 16 toward the top partition 22 of the heat treat chamber 14. The bottom partition 24 of the heat treatment chamber 14 is mounted to a hydraulic cylinder 36 (FIG. 2) adapted to raise and lower the bottom partition 24 into and out of the quenching bath 18.

Referring particularly to FIGS. 3 and 3A, it may be seen that the top partition 22 of the heating chamber 14, includes a plurality of rectangular shaped apertures or vents/louvres 40 which provide communication between the air plenum 16 and interior of the heat treatment chamber 14. The plural vents 40 are preferably formed in parallel rows and equidistantly spaced from one another. Each of the parallel rows of the vents 40 cooperate with the pair of slider plates 42 which include a plurality of complimentary shaped and spaced apertures 44 formed therein. The slider plates 42 are movably mounted upon the top surface of the partition 22 by one or more mounting ears 46 which permit the slider plates 42 to be reciprocated or slid upon the top surface of the partition 22 in a back and forth motion as indicated by the arrow in FIG. 3A. During such back and forth reciprocating motion, the apertures 44 formed in the slider plates 42 selectively cover and uncover the vents 40 formed in the top partition 22 and thus, permit the size of the air vents 40 to be adjusted.

Each of the side wall partitions 26 and 28 of the heat treatment chamber 14 are provided with an elongate aperture or damper 50 which preferably extends laterally adjacent the lower surface of the partition 26 and 28 to permit air communication from the interior of the heat treatment chamber 14 to the space formed between the side partitions 26 and 28 and housing 20. Both of the dampers 50 are provided with a cover plate 52, preferably pivotally mounted to the side partitions 26 and 28 at their uppermost end and adapted to selectively cover and uncover the damper openings 50.

With the basic structure defined, the operation of the heat treatment furnace 10 of the present invention may be described. Initially, the plurality of heating elements 100 disposed on the interior surface of the thermal insulation 20 are energized, causing the same to raise the temperature. Due to the side partitions 26 and 28 of the heating chamber 14 being inwardly spaced from the thermal insulation 20 and heater elements 100, direct radiant and convectional heat transfer from the heating elements 100 into the interior of the heat treatment 14. chamber 14 is retarded with the major heat transfer occurring exclusively within the flow passage defined by the spacing between the side wall partitions 26 and 28 and insulation 20. Activation of the circulating fan 30 causes the air in the area adjacent the plural heating element 100 to be drawn upward across the heating elements 100 wherein convectional heat transfer from the heating element 100 to the air is effectuated and subsequently, the heated air enters into the intake duct 32 of the air plenum 16 as indicated by the arrows in FIGS. 1 and 2. The fan 30 subsequently discharges the heated air downward within the air plenum 16 toward the top partition 22 of the heat treatment chamber 14. As the air is discharged through the air plenum 16, it enters into the heat treatment chamber 14 through the plural air plenum vents 40 formed on the top partition 22 of the heating chamber 14 and travels downward throughout the length of the heat treatment chamber 14, wherein it contacts the fabricated parts desired to be heat treated (not shown) disposed within the heat treatment chamber 14. Upon passage across the parts, the air exits through the damper openings 50 formed on the side partitions 26 and 28 adjacent their lowermost end and is recirculated in a continuous repetitive cycle upward across the plural heating elements 100.

Thus, as will be recognized, the heat transfer from the air to the fabricated parts (not shown) is effectuated exclusively by convectional heat transfer as opposed to radiant heat transfer which is extremely critical in the heat treatment of aluminum fabricated parts. Once the prefabricated part has been raised to a suitable temperature within a predetermined time period, the hydraulic cylinder 36 may be lowered causing the bottom partition 24 of the heat treatment chamber 14 and the prefabricated parts (not shown) supported thereon, to rapidly lower into the quenching bath 18 to effectuate the proper heat treatment of the prefabricated parts.

It is an important feature of the present invention that the air flow path generated through the heat treatment chamber 14 is uniform and in addition, the air plenum vents 40 and heat treatment chamber dampers 50 are remotely adjustable during the heat treatment operation and/or furnace certification. The particular means for effectuating these desired results in the present invention are depicted in FIGS. 2, 3A, and 4.

The particular uniform flow means comprises a plurality of directional vanes 60 which are mounted upon the lowermost surface of the top partition 22 of the heat treatment chamber 16. The directional vanes 60 are 16. preferably formed of heavy gauge sheet metal 60 extending in a direction generally normal to the plane of the top partition 22 and are registered with the vent openings 40 formed therein. As such, the directional vanes 60 form an extended discharge shoot about the vents 40 which insures that air flow through the plenum vents 40 is maintained in a direction generally normal to the plane of the top partition 22 as indicated by the arrows in FIG. 2. Thus, heated air traveling through each of the plural plenum vents is directed in a generally parallel and uniform flow pattern throughout the length of the heating chamber 14 which has been found to yield generally consistent temperature readings throughout the interior of the heat treatment chamber 14 and thereby reduce undesirable temperature gradients within the same.

The particular actuator means for effectuating the remote adjustment of the air plenum vents 40 and heat treatment chamber dampers 50 is illustrated in FIG. 4. Due to the particular means being common to both the air plenum vents 40 and dampers 50, the structure is only defined in relation to the heat treatment chamber dampers 50.

The remote control actuator means 70 comprises an elongate rod 72 having one end disposed adjacent the exterior of the housing 12 and the other end attached to the damper plate or gate 52 by means 74 which permit rotational and moderate transverse movement of the gate 52 relative to the end of the rod 72. The intermediate portion of the rod 72 extends through an aperture 76 formed through the thermal insulation 20 as well as a tubular coupling 78 rigidly mounted to the exterior surface of the housing 12. The inside diameter of the coupling 78 as well as the diameter of the aperture 76 is sized to be substantially greater than the outside diameter of the rod 72 to permit moderate bending and/or deflection of the rod 72 therein. An elongate sleeve 80 is mounted to the distal end of the coupling 78 as by way of a hose clamp 82, and is preferably formed of a high temperature resistant flexible, elastromeric material capable of deflecting or bending without permanent deformation A suitable plug 84 is rigidly mounted to the distal end of the elastromeric sleeve 80 as by way of an additional hose clamp 86 and includes an axially extending threaded aperture 88 (indicated by the phantom lines in FIG. 4) which mates with complimentary formed threads 90 formed adjacent the distal end of the elongate rod 72. A hand wheel 92 is provided at the distal end of the elongate rod 72 and suitable fiber insulation material is packed within the interior of the elastromeric sleeve 80, coupling 78 and aperture 76.

In operation, manual turning of the hand wheel 92 causes the elongate rod 72 to reciprocate either inwardly or outwardly relative the plug member 88, causing the gate 52 to pivot about its uppermost end between a fully opened and fully closed position (indicated by the phantom lines in FIG. 4). As thermal expansion and contraction causes deflection or bending in the length of the elongate rod 72, such deflection or bending is automatically compensated for by a corresponding deflection in the elongate elastromeric sleeve 80, and by the oversized diameter of the aperture 76 and opening formed in the coupling 78. Thus, binding of the rod 72 within the internal threaded aperture 88 of the plug is eliminated.

As will be recognized, due to the remote control means 70 of the present invention, continuous adjustment of the heat treatment chamber dampers 50 and plenum vents 40 may be readily accomplished throughout the actual heat treatment process. Hence, the requirement of shutting down the heat treatment operation to effectuate manual adjustments of the vents and dampers as heretofore associated in the prior art has been eliminated, which has been found to permit certification of the heat treatment furnace 10 in a fraction of the time and at a fraction of the cost of conventional prior art furnaces.

To augment the improved air flow characteristics and remote control, damper, and air plenum vent features, the present invention additionally incorporates an improved ribbon heating element/ceramic fabric insulation structure and method of construction, which although is particularly suited for aluminum solution type heat treatment furnaces, is additionally applicable to other conventional types of heat treatment furnaces. To obtain a complete understanding of the specific differences and benefits made possible in the improved structure and method of construction of the present invention, a review of the two basic prior art insulation/-heater element systems is helpful; with FIG. 5 depicting the prior art ribbon/rigid ceramic block type prior art system. and FIG. 6 depicting the more recent ceramic fiber/bendover rod heating system.

Referring to FIG. 5, the ribbon type prior art system utilizes an elongate resistive heating ribbon 120 typically formed of a nickel-chromium alloy which is threaded between a plurality of spool-like ceramic insulators 122. Due to the requirement of the ribbon heating elements 120 being maintained in moderate tension, each of the spools 122 are mounted upon elongate metal pins 124 which are secured to and integrally formed within a plurality of rigid ceramic insulation blocks or refractory bricks 126. Each of the blocks 126 are rigidly connected together to form a composite structure and are mounted to the housing 12 of the furnace to form both an electrical as well as thermal bearer between the ribbon heating elements 120 and the housing 12.

The use of such prior art rigid ceramic block/ribbon heater element assembly possesses both advantages and deficiencies. The advantages of such a system reside in the relatively small n'ass of the ribbon type heater element 120 which permits rapid convectional heat transfer with heat energy being readily wiped from the relatively large heat transfer surface of the ribbon 120 during air passage across the same. Similarly, such ribbon type heater elements 120 primarily exhibit convectional heat transfer characteristics as opposed to radiant, and can be previsely controlled by power input to yield a desired air temperature within the furnace. However, the use of the rigid ceramic blocks 126 adds substantially to the overall manufacturing cost and weight of the composite heat treatment furnace and further, the blocks possess extremely slow recovery times from quenching, thereby adding substantially to the overall operating costs of the furnace.

In FIG. 6, the more recently developed ceramic fiber bendover rod heating element system is depicted. In this more recent prior art system, the rigid ceramic blocks 126 have been replaced by a lightweight, wool-like, readily deformable ceramic fiber material 130 which is preferably fabricated in a block-like configuration. Such ceramic fiber blocks 130 are currently manufactured by a variety of manufacturers under such trademarks as CAYO-WOOL and PYRO-BLOCK. The fiber blocks 130 may be attached to the interior of the housing 12 as by way of connection to a fabric mesh attached to the rear surface of each of the blocks 130. The ceramic fiber blocks 130, however, fail to possess the structural integrity of the rigid ceramic blocks 126 and, hence, have been incapable of supporting the tensile forces exerted in ribbon type heater elements 120. Hence, bendover rod heater elements 132 which are formed in a rigid self-supporting configuration have exclusively been utilized in combination with the ceramic fiber blocks 130. Due to the calrod 132 being self-supporting, in the prior art assembly, it is only necessary for the ceramic fiber blocks 130 to support the weight of the same which has typically been accomplished by connection of the rod heater elements 32, as by way of hooks 134, to a ceramic rod 136 mounted within the ceramic fiber blocks 130.

As with the prior art rigid cermaic block/ribbon type heater element assembly, the ceramic fiber insulation/-rod system of the prior art has advantages as well as disadvantages. The advantages are manifested by the superior insulation and weight reduction qualities of the ceramic fiber blocks 130 which dramatically reduce recovery time from the quenching operation. However, the bendover rod heater elements 132 exhibit radiant as well as convectional heat transfer characteristics and further, due to their relatively large mass, are incapable of being precisely controlled to yield heat treatment chamber temperatures within suitable tolerances. Thus, there exists a substantial need in the art for a structure and method of constructing a heat treatment furnace which permits the utilization of the improved ceramic fiber insulation blocks 130 with the superior ribbon type heater elements 120.

This need in the art has been specifically addressed and fulfilled by the present invention which structure and method of construction is illustrated in FIGS. 7 through 11. Referring to FIG. 7, the improved method and structure of the present invention contemplates, the affixation of a plurality of ceramic fiber blocks 130 on to the interior surface of the housing 12 as by way of inner-connection of fabric mesh attached to the rear surface of each of the blocks 130. As shown, the plurality of blocks 130 are arranged in a brick wall like orientation and provide a thermal as well as an electrical insulation bearer from the housing 12. Due to the structural inability of the ceramic fiber blocks 130 to support the tensile forces required in the direct mounting of the ribbon type heater elements 120 upon the same, the present invention contemplates the use of a supporting member or cartridge 140, which may be affixed to the exterior surface of the ceramic blocks 130 to provide the sole support means for the ribbon type heater elements 120.

The cartridge 140 is preferably formed in a rectangular picture frame-like configuration formed of light gauge steel and includes a plurality of annular apertures 142 to reduce the overall weight of the same. The exterior and interior perimeter edges 144 of the cartridge 142 are bent over and disposed in a plane substantially normal to the main facial plane of the cartridge 142, which provide addtional structural stability for the cartridge 140. A plurality of equi-spaced rectangular openings 146 are additionally formed in the cartridge 140 each of which is adapted to receive an elongate pin 148. As best shown in FIG. 8, each of the elongate pins 148 include a pair of flanges 150 at their innermost end which are adapted to directly abutt the innersurface of the cartridge 140 and may be rigidly mounted thereto as by way of a spot weld 152.

With the pins 148 mounted to the cartridge 140, the plurality of cartridges 140 are positioned upon the interior surface of the ceramic fiber blocks 130. As depicted in FIG. 7, to enable the plural cartridges 140 to be mounted upon the ceramic fiber blocks 130, a plurality of score lines or grooves 150 are cut into the blocks 130 as by way of a knife (not shown) and are registered to coinside with and receive the perimeter portions 144 of the cartridge 140. Prior to placement of the cartridge 140 upon the blocks 130, a suitable high temperature adhesive is applied to the score lines 150 as well as the interior surface of the cartridge 140 such that when the perimeter portions 144 and cartridge 140 are inserted into the score lines 150 and against the fiber blocks 130 respectively, the adhesive flows into the plural apertures 142 formed on the cartridge 140 and maintains the cartridge upon the blocks 130. As will be recognized, a plurality of the cartridges 140 are mounted upon the ceramic fiber blocks 130 in a similar manner, yielding a cartridge placement pattern as depicted in FIG. 9.

With the plural cartridges 140 adhesively affixed to the ceramic fiber blocks 130, a second set of ceramic fiber blocks 130A is positioned over the cartridges 140 to embed the cartridges 140 in an insulation-sandwich configuration. The second set of ceramic fiber insulation blocks 130A are preferably cut with a die (not shown) to form a plurality of rectangular shaped apertures 160 therethrough, each sized and spaced from one another to receive the pins 148 mounted to the cartridge 140. The second set of blocks 130A may be secured to the plural cartridges 140 and first set of ceramic fiber blocks 130 by applying an additional adhesive coating, and are salarly positioned in a brick wall like configuration as depicted in FIG. 9.

With the plural cartridges 140 embedded between the first and second ceramic fiber block insulation layers 130 and 130A conventional ceramic insulation spools 162 are positioned over the distal ends of each of the pins 148. To maintain the spools 162 in their desired axial position, a pair of cotter pins 164 may be inserted through a pair of apertures 166 formed in the pins 148. Subsequently, the length of ribbon type heater elements 120, may be threaded between adjacent ceramic spools 162 preferably a diagonal pattern to mount the ribbon heater element 120 thereupon.

As will be recognized, due to the pins 168 being rigidly attached to the cartridge 140, the tensile forces required in mounting the ribbon heater element 120 is carried exclusively by the pins 148 and cartridge 140 which possesses sufficient rigidity and strength to maintain the structural integrity of the heater ribbon/spool assembly. Similarly, due to the strength of the assembly being carried exclusively by the cartridge 140, the ceramic fiber blocks 130 and 130A need only support the weight of the cartridge 140, spools 162, and ribbon heater elements 120, which the applicants have found to be readily accommodated by the ceramic fiber blocks 130. Thus, the structure and method of the present invention permits the superior heating control and convectional heat transfer characteristics of the ribbon type heater elements 120 to be utilized in combination with the superior insulation and weight properties of the ceramic fiber insulation blocks 130.

Those skilled in the art will recognize that although for descriptive purposes specific part configurations and materials have been defined in the specifications, modifications to the same can be readily accommodated and such modifications are clearly contemplated to the spirit of the present invention.

What is claimed is:

1. In a heat treatment furnace having a housing, a heat treatment chamber disposed within the interior of said housing sized to receive parts therein and a fan for circulating a quantity of air through said heat treatment chamber, the improvement comprising:

a first insulation layer affixed to the interior of said housing, said first layer formed of a readily deformable ceramic fiber material;

a rigid cartridge mounted to one surface of said first insulation layer and maintained in a generally contiguous orientation with said first layer;

a second insulation layer affixed to said one surface of said first insulation layer and sized to cover said rigid cartridge, said second insulation layer formed of a readily deformable ceramic fiber material; and a thin ribbon heating element mounted in tension between plural pins extending outward from said rigid cartridge and through said second insulation layer said heating element adapted to heat by convection, a quantity of air circulating through said heat treatment chamber.

2. The heat treatment furnace of claim 1 wherein said rigid cartridge comprises a frame member partially embedded within said first insulation layer.

3. The heat treatment furnace of claim 2 wherein said rigid cartridge is adhesively affixed to said first insulation layer.

4. The heat treatment furnace of claim 3 wherein said heating element is mounted in tension between plural spools affixed on one end of said plural pins.

5. The heat treatment furnace of claim 4 wherein said first and second insulation layers are formed of a plurality of insulation blocks abutted together in a blockwall like orientation.

6. The heat treatment furnace of claim 5 wherein said frame member includes a plurality of apertures formed therein to reduce the weight of said frame member.

* * * * *